US007707757B2

(12) United States Patent
Crowell

(10) Patent No.: US 7,707,757 B2
(45) Date of Patent: May 4, 2010

(54) MULTI-PANEL DISPLAY PRODUCT

(76) Inventor: Christopher S. Crowell, 66-2A Tinker La., Lyme, CT (US) 06371

( * ) Notice: Subject to any disclaimer, the term of this patent is extended or adjusted under 35 U.S.C. 154(b) by 303 days.

(21) Appl. No.: 11/454,209

(22) Filed: Jun. 16, 2006

(65) Prior Publication Data

US 2007/0028494 A1 Feb. 8, 2007

Related U.S. Application Data

(60) Provisional application No. 60/697,068, filed on Jul. 5, 2005.

(51) Int. Cl.
*G09F 11/00* (2006.01)

(52) U.S. Cl. ..... 40/491; 40/490; 446/149

(58) Field of Classification Search ..... 40/375, 40/491, 124.191, 675, 615, 610, 488, 490; 434/199, 405; 446/149, 151
See application file for complete search history.

(56) References Cited

U.S. PATENT DOCUMENTS 2,086,047 A * 7/1937 Rand ..... 40/395
2,524,965 A * 10/1950 Eddy ..... 40/382
3,122,859 A * 3/1964 La Reaux, Jr. ..... 446/152
3,286,383 A * 11/1966 Osher ..... 40/534
3,757,934 A * 9/1973 Taub ..... 206/768
6,023,867 A * 2/2000 Gagne ..... 40/491
6,532,691 B2 * 3/2003 Carlin et al. ..... 40/491
7,261,051 B2 * 8/2007 Tipaldo ..... 116/63 P

* cited by examiner

*Primary Examiner*—William L. Miller

(57) ABSTRACT

By providing a unique housing member within which a plurality of separate display and holding members are operatively interconnected for sequential display relative to each other in a unique, cooperative, continuous, extending manner, a unique, hands-on, visually exciting and interest generating multi-panel display and holding system is realized. In the preferred construction of the present invention, a plurality of separate and independent display and/or holding members are cooperatively interconnected to each other for sequential movement relative to each other. Furthermore, each of the display/holding members are also constructed for being automatically positioned in a precisely desired continuous array in response to the receipt of pulling or movement force applied to one of the display/holding members or to a designated lead element.

16 Claims, 10 Drawing Sheets

51
60
67
68
69
70
71
20
72
74
73
52
53
54
55
56
57
61
62
63
1
2
3
4
5
6

Attaching Cards Variants

FIG 24
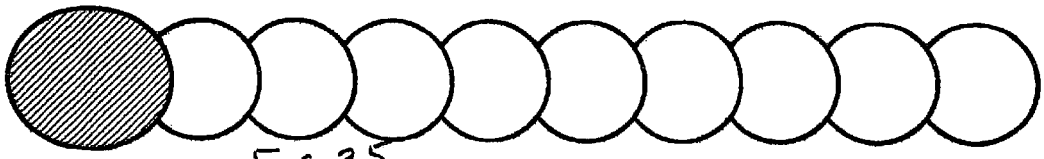
FIG 25
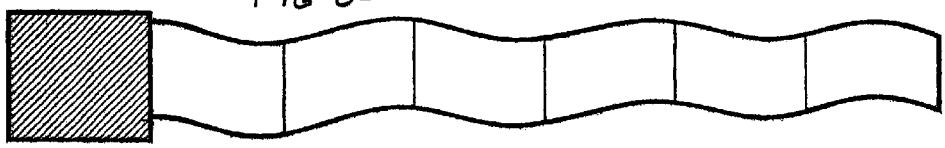
FIG 26
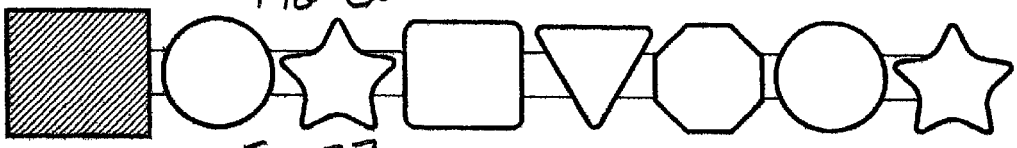
FIG 27
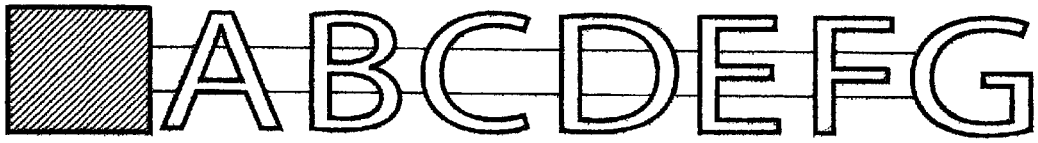
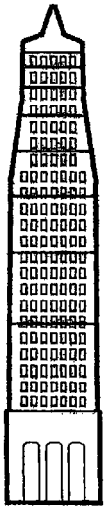
FIG 28
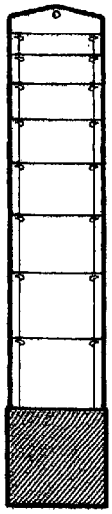
FIG 29
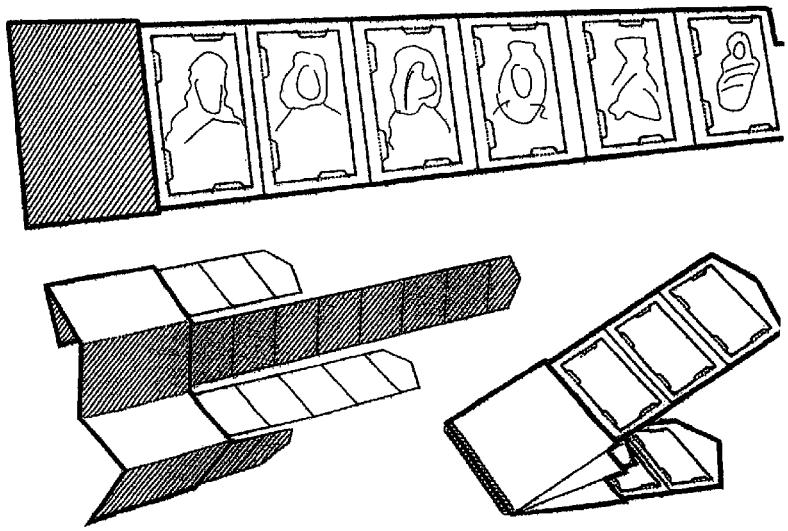
FIG 30

MULTI-PANEL DISPLAY PRODUCT

RELATED APPLICATIONS

This application is related to U.S. Provisional Patent Application Ser. No. 60/697,068, filed Jul. 5, 2005 entitled MULTI-PANEL DISPLAY PRODUCT.

TECHNICAL FIELD

This invention relates to multi-panel products and, more particularly, to such products which enable movement of a plurality of interconnected components thereof.

BACKGROUND ART

With the ever increasing quantity of products and services being offered to consumers, substantial interest has been given to promotional display systems for advertising such products and services. In this regard, a wide variety of advertising displays and promotional literature has been created and distributed to consumers. However, due to the deluge of material to which average consumers are constantly exposed, greater emphasis has been placed upon developing eye-catching, visual displays and promotional material which will receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when unfolded or opened. However, in spite of the unique visual appearance generated by such products, the overall cost of production and complexity of assembly of these systems has prevented such prior art systems from becoming popular.

Other prior art displays have attempted to generate consumer interest by providing unique visual images or other indicia as an integral part of the display. However, these prior art attempts have also failed to generate the interest being sought, largely due to an inability to physically involve the consumer in the promotion or display.

In addition, other products, such as greeting cards, have attempted to generate consumer interest. However, consumer involvement in the card display has not been achieved.

Furthermore, consumers have long sought to obtain a unique display system which the consumer could adapt by mounting pictures, cards, or the like on uniquely constructed support panels. However, no such system exists in the prior art.

Therefore, it is a principal object of the present invention to provide a multi-panel display product which is capable of being produced at a reasonable cost and provides an exciting, interest-generating display and/or holding member.

Another object of the present invention is to provide a multi-panel display product having the characteristic features described above, which enables the consumer to physically control the presentation of the display in a unique, hands-on manner.

Another object of the present invention is to provide a multi-panel display product having the characteristic features described above, which is capable of mass production and assembly.

A further object of the present invention is to provide a multi-panel display product having the characteristic features described above, which provides a unique, eye-catching, exciting and surprising display which is produced in response to action by the consumer.

Another object of the present invention is to provide a multi-panel display product having the characteristic features described above, which the consumer can adapt for personal use and display of personal photographs, cards, pictures and the like.

Other and more specific objects will in part be obvious and will in part appear hereinafter.

SUMMARY OF THE INVENTION

By employing the present invention, all of the difficulties and inabilities of the prior art are eliminated and a unique, hands-on, visually exciting and interest generating multi-panel display and holding system is realized. This desirable result is attained in the present invention by providing a unique housing member within which a plurality of separate display and holding members are operatively interconnected for sequential display relative to each other in a unique, cooperative, continuous, extending manner.

In accordance with the present invention, a housing or containing element is provided which incorporates a front panel and a rear panel mounted in juxtaposed, spaced, overlying relationship with each other, defining an interior zone therebetween. Preferably, each panel comprises an eye-catching, visual display for generating consumer interest. Alternatively, the user of the multi-panel display/holding assembly is able to mount any desired pictures, information bearing panels, or other indicia on the surfaces of the housing for providing a personalized, self created display.

In addition to the housing or containing element of the present invention, the preferred construction of the present invention also comprises a plurality of separate and independent display and/or holding members which are cooperatively interconnected to each other for sequential movement relative to each other. Furthermore, each of the display/holding members are also constructed for being automatically positioned in a precisely desired continuous array in response to the receipt of pulling or movement force applied to one of the display/holding members or to a designated lead element.

In this regard, by employing the present invention, a multi-panel display/holding assembly is realized which enables the user to merely input a force to a desired or designated element/panel and automatically obtain an elongated, continuous, staggered display of a plurality of separate and independent display/holding members. In addition, each of the independent display/holding members is sequentially revealed after the previous display/holding member connected thereto is revealed. As a result, a unique, eye-catching, exciting, and interest generating visual display is realized.

In the present invention, each display/holding member is interconnected to each adjacent display/holding member by an interlocking track assembly which guides the movement of the display/holding member. As a result, each display/holding member is able to emerge from the housing or containing element in a sequential, continuous, staggered manner with one display/holding member being revealed in its entirety prior to the next display/holding member being revealed.

By continuing to input the required force, each of the display/holding members is independently revealed in a continuous manner, until all of the display/holding members are visible. As a result, an elongated, continuous, visual display of a plurality of unique, distinctive, and interlocked members is provided. Furthermore, by providing pre-printed indicia on each display/holding member or by mounting desired pictures, images, or other informative material on each display/holding member, a unique, eye-catching, exciting, and interest generating visual display is realized.

Furthermore, in the present invention, a variety of alternate track systems and interlocking assemblies and constructions have been developed. In this way, a wide variety of alternate display configurations and visual and structural constructions are capable of being achieved and presented to the user. As a result, substantially improved and enhanced consumer interest and visual excitement is obtained.

In accordance with the present invention, the visual display placed upon each display/holding member typically comprises one or more selected from the group consisting of pictures, alphanumeric information, colors, designs, photographs, stickers, panels and other indicia. In addition, each visual display may comprise a separate and independent concept or, alternatively, may be related to the display contained on an adjacent display/holding member. In this regard, numerous alternate configurations can be realized, ranging from separate photographs of one or more trips to an elongated, continuous, related display of a train, limousine, or any desired product. Regardless of which type of configuration is employed, the consumer or user realizes a unique, eye-catching and interest generating product.

By employing the sequentially movable, multi-element, multi-panel, display/holding system of this invention, visually exciting and interest generating products are realized, including greeting cards, advertising/promotional products, and memory sharing products which enable a consumer to physically engage a portion of one display/holding member and cause each cooperating, associated display/holding member to be displayed in a continuous, sequential, controlled manner, in order to produce the resulting elongated display system to the enjoyment of the consumer.

Furthermore by providing pertinent common interest-generating indicia on the exposed surfaces of each display/holding member, any desired message, information, or memories can be conveyed to the consumer/user with a unique display/holding system being achieved which captures the interest, excitement, and imagination of the consumer. In this way, consumer/user interest is generated both in the display/holding member product as well as in the message or memories being provided by the product.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to following detailed description taken in connection with the accompanying drawings, in which:

FIG. 13 is a series of top plan views depicting a still further alternate embodiment of the present invention and an alternate track system employed there with;

FIGS. 14-30 are top plan views depicting a plurality of alternate constructions showing the wide versatility and alternate construction systems and depictions which are capable of being attained using the present invention.

DETAILED DESCRIPTION

By referring to FIGS. 1-30, along with the following detailed discussion, the preferred constructions and operation of a plurality of alternate embodiments of the present invention can best be understood. In each of these embodiments, a plurality of display/holding members are cooperatively associated with each other and retained in a housing or containing element from which each of the individual members are able to be sequentially moved from a stowed or stored position to a fully displayed position.

Although this disclosure and the associated drawings fully detail several alternate preferred embodiments of the present invention, further alternate embodiments can be implemented without departing from the scope of this invention. Consequently, it is to be understood that the following disclosure is provided for exemplary purposes only and is not intended as a limitation of the present invention, with all alternate embodiments which are evident from this disclosure being encompassed within the scope of the present invention.

Figure 1:
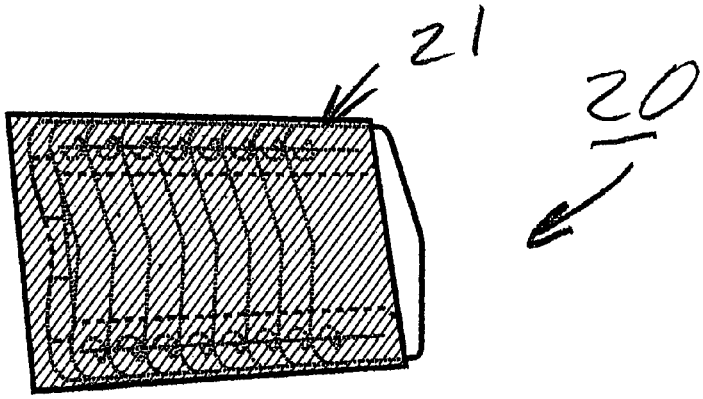
FIG. 1 is a perspective view of the multi-panel display and holding system of the present invention shown with each of the panels in their closed, compact position, retained in a housing.
Figure 2:
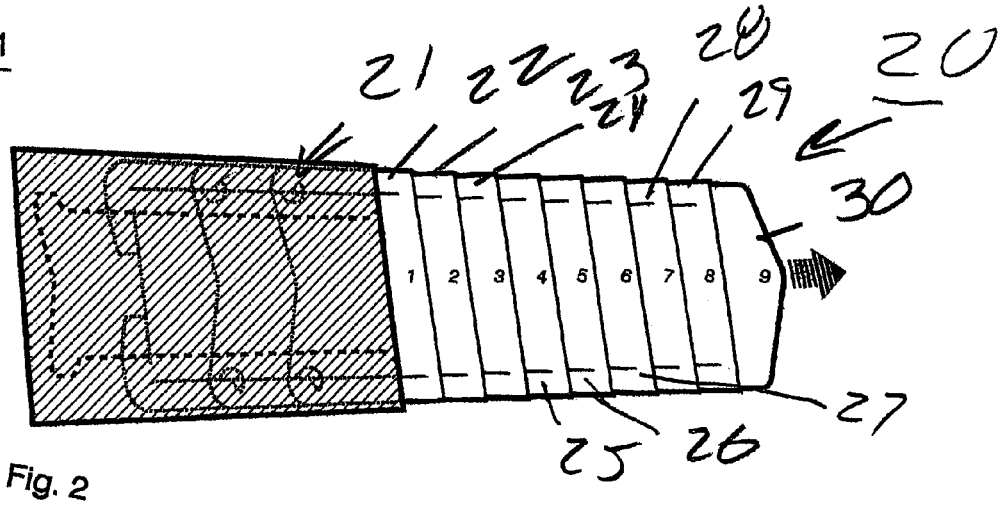
FIG. 2 is a perspective view of the multi-panel display and holding system of FIG. 1 with the panels partially removed from the housing.
Figure 3:
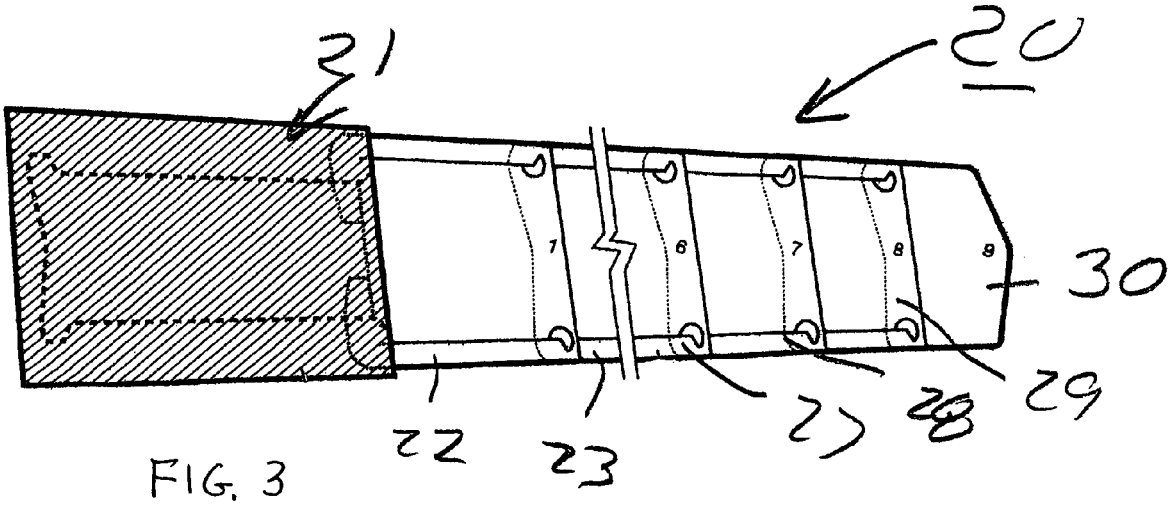
FIG. 3 is a perspective view of the multi-panel display and holding system of FIG. 1 with the panels shown completely extended from the housing.

In FIGS. 1-4, a first preferred embodiment of the present invention is depicted. In this embodiment, multi-panel display and holding system 20 of the present invention is shown comprising housing or containing element 21 in combination with display/holding members 22, 23, 24, 25, 26, 27, 28, 29, and 30. In FIG. 1, multi-panel display and holding system 20 of the present invention is shown in its stored, fully compacted configuration, wherein each of the display/holding members 20-30 are mounted in overlying cooperating relationship with each other, fully contained within housing and containing element 21. In FIG. 2, display/holding members 22, 23, 24, 25, 26, 27, 28, 29 and 30 are all depicted partially removed from housing or containing element 21, while FIG. 3 depicts the display/holding members in their fully extended and displayed configuration.

As depicted, display/holding members 22-30 are constructed in a manner which enables display/holding members 22-30 to emerge from housing/containing element 21 in a continuous, elongated, substantially straight line and remain in that configuration when fully displayed. As is fully discussed below, in the preferred construction, each display/holding member is revealed in its entirety before the next display/holding member is revealed. In order to achieve this sequential visual display and configuration, display/holding members 22-30 are constructed for being in overlying, aligned, cooperating relationship with each other, and retained in housing/containing element 21 with display/holding members 22-30 in juxtaposed, overlying facing relationship.

In the preferred construction of this embodiment of the present invention, display/holding members 22-30 each comprise different overall lengths, in order to enable display/holding members 22-30 to be completely stored in housing/containing element 21 in overlying relationship with each other. By referring to FIG. 4, this construction and the varying lengths of each display/holding member is immediately apparent.

Figures 4, 4A, 4B, 4C:
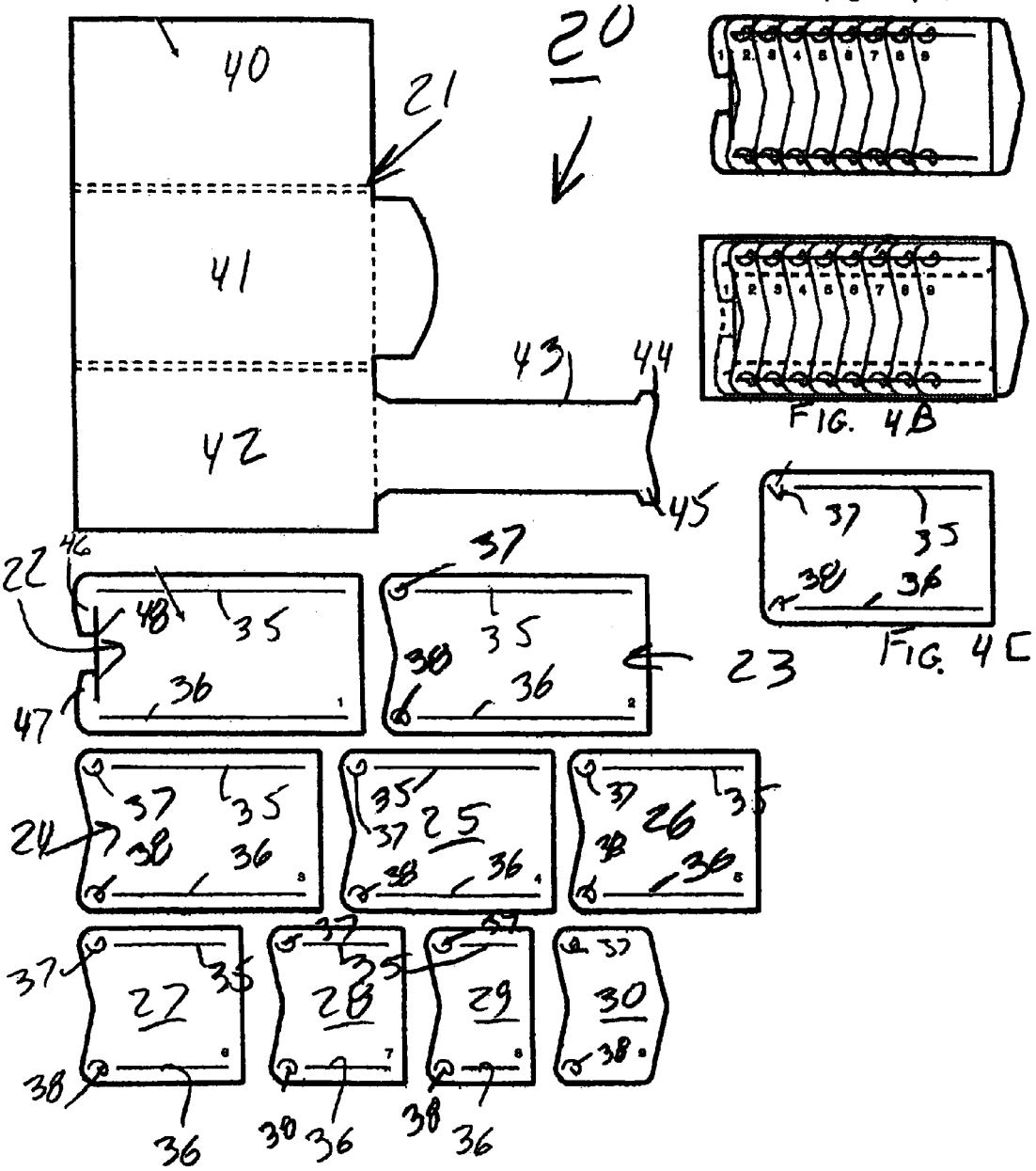
FIG. 4 is a top plan view of the multi-panel display and holding system of FIG. 1 shown completely disassembled.

In order to achieve the desired continuous, longitudinal, extending, side-by-side, cooperating, sequential, display depicted in FIGS. 1-3 and detailed above, each display/holding member 22-29 incorporates a pair of elongated, longitudinally extending, substantially straight, cooperating slots 35 and 36 which are formed adjacent the opposed side edges of each display/holding member. In addition, display/holding members 23-30 each incorporate a pair of track engaging fingers or hook members 37 and 38, each of which are positioned directly adjacent one of the elongated slots 35 and 36. As shown in FIG. 4C, the track engaging fingers/hook members 37 and 38 may comprise a "V" shape, as opposed to the "C" shape shown in FIGS. 1-4.

As shown in the drawings, by lockingly engaging finger or hook member 37 of display/holding member 23 in slot 35 of display/holding member 22, while also lockingly engaging finger/hook member 38 of display/holding member 23 in slot 36 of display/holding member 22, display/holding members 22 and 23 are cooperatively associated with each other. By employing this construction, display/holding member 23 is able to advance longitudinally in a substantially straight path, relative to display/holding member 22 by pulling the leading edge of display/holding member 23, causing fingers/hook members 37 and 38 to slidingly advance along the length of elongated slots 35 and 36.

Using a similar construction, fingers/hook members 37 and 38 of display/holding member 24 are mounted in elongated slots 35 and 36 of display/holding member 23, while finger/hook members 37 and 38 of display/holding member 25 are mounted in elongated slots 35 and 36 of display/holding member 24. The desired, longitudinally extending construction for display/holding system 20 is attained by similarly mounting finger/hook members 37 and 38 of display/holding members 26, 27, 28, 29 and 30 in the elongated slots 35 and 36 of the adjacent display/holding member associated therewith. In this way, the desired longitudinally extendable construction is realized for enabling display/holding members 22-30 to be longitudinally displayed in a continuous, elongated, interlocked, substantially straight line configuration.

By employing this construction, display/holding member 30, which is the leading member, is removed from housing/containing element 21 and fully displayed by having a force applied thereto which causes display/holding member 30 to slidingly advancing along elongated slots 35 and 36 of adjacent display/holding member 29 by the engagement of fingers/hook members 37 and 38 therein. Once finger/hook members 37 and 38 of display/holding member 30 reaches the terminating end of slots 35 and 36, the continued application of a force to display/holding member 30 causes display/holding member 30 and display/holding member 29 to be removed from housing/contacting element 21 and by slidingly advancing finger/hook members 37 and 38 of display/holding member 29 along slots 35 and 36 of display/holding member 28.

Once display/holding member 29 is a fully displayed, along with display/holding member 30, the continued application of the force to display/holding member 30 causes display/holding member 28 to be withdrawn from housing/containing element 21 and become fully displayed as the fingers/hook members 37 and 38 thereof slidingly advance along slots 35 and 36 of display/holding member 27. As is evident from this disclosure, this process continues with each display/holding member being fully displayed in a continuous, step-by-step process, until all of the display/holding members 22-30 have been removed from housing/containing element 21 and are fully displayed in their entirety. Once in this position, the particular indicia, advertising display, message, design, logo, colors, photographs, etc. which are mounted and/or displayed on display/holding members 22-30 are seen in their entirety by the consumer or user.

In the preferred construction of this embodiment of the present invention, housing/containing element 21 incorporates a plurality of cooperating panels 40, 41, and 42 which are foldable relative to each other, with panels 40 and 41 forming outside panels, the surfaces of which are visible, with panel 42 being captured between panels 40 and 41. In addition, in the preferred construction, interior panel 42 also incorporates an elongated slide arm 43 integrally mounted to one edge thereof and terminating at its opposed end with upstanding ridges 44 and 45.

In addition, display/holding member 22 is constructed with locking fingers 46 and 47 formed on one end thereof in cooperating relationship with slot 48. This construction is configured for enabling elongated slide arm 43 to be telescopically inserted through slot 48, with locking fingers 46 and 47 peripherally surrounding and engaging arm 43.

When fully assembled, locking fingers 46 and 47 peripherally surround and embrace the edges of elongated slide arm 43, enabling display/holding member 22 to slide along the length of arm 43 through slot 48. However, complete removal of display/holding member 22 from arm 43 is prevented due to the engagement of upstanding ridges 44 and 45 with locking fingers 46 and 47. As a result, display/holding member 22 is capable of sliding along the length of arm 43, while also being retained within housing/containing element 21 to prevent its complete removal therefrom.

In FIGS. 5-8, a second preferred embodiment of the present invention is depicted. In this embodiment, multi-panel display and holding system 20 is shown comprising housing or containing element 51 in combination with display/holding members 52, 53, 54, 55, 56, and 57. As detailed below, this embodiment of the present invention is constructed in a manner substantially equivalent to the construction detailed above referenced in FIGS. 1-4. However, in this embodiment, display/holding members 52, 53, 54, 55, 56, and 57 are constructed with substantially identical overall sizes and shapes. In addition, when display/holding members 52-57 are sequentially withdrawn from housing/containing element 51, each display/holding member moves along a curved path before being positioned directly adjacent to the next display/holding member, forming an elongated, continuous chain display.

Figure 5:
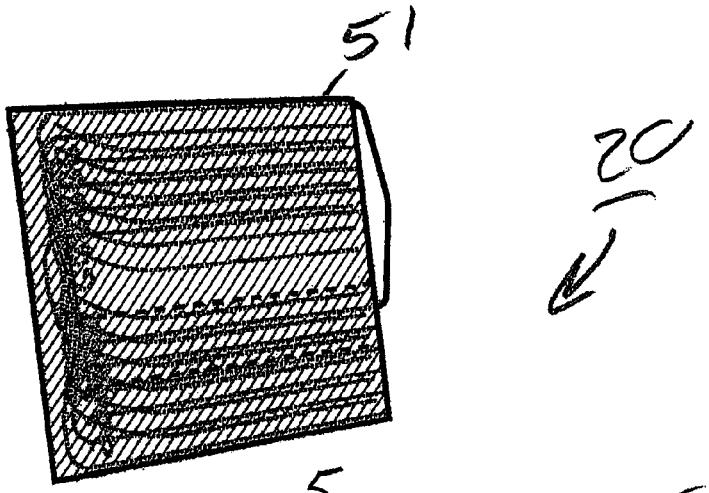
FIG. 5 is a perspective view of an alternate embodiment of the multi-panel display and holding system of the present invention shown with each of the panels in their closed, compact position, retained in the housing.
Figure 6:
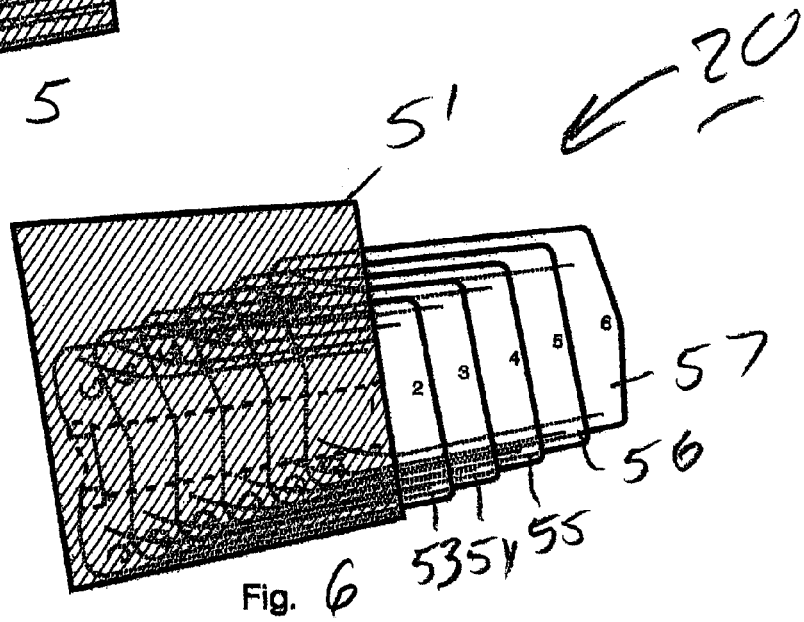
FIG. 6 is a perspective view of the multi-panel display and holding system of FIG. 5, with the panels partially removed from the housing.
Figure 7:
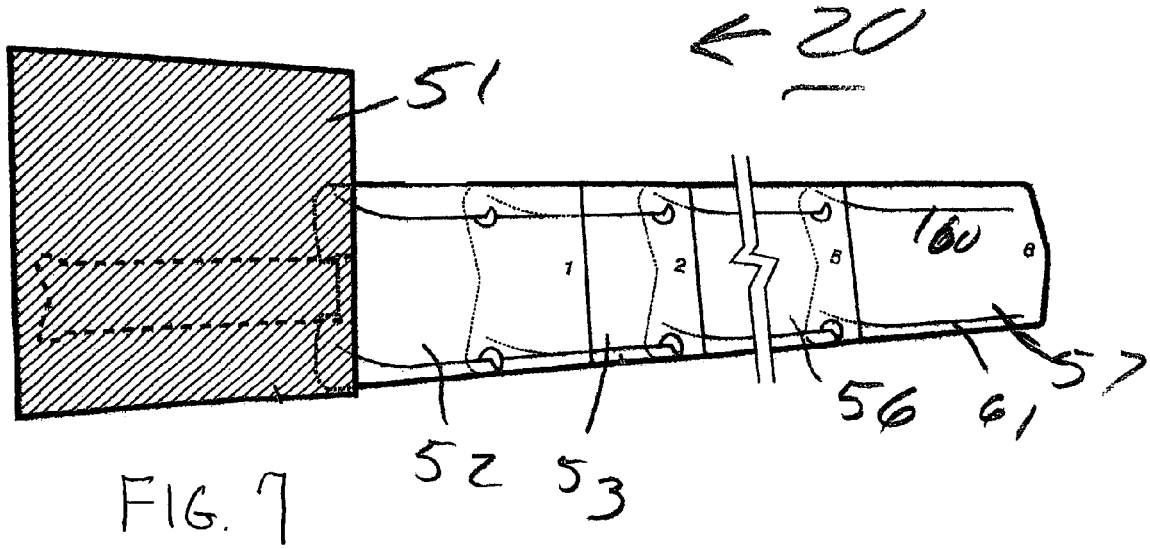
FIG. 7 is a perspective view of the multi-panel display and holding system of FIG. 5, with the panels shown completely extended from the housing.

In this regard, in FIG. 5, multi-panel display and holding system 20 is shown in its stored, fully compact configuration, with each of the display/holding members 52-57 mounted in cooperating relationship with each other and fully contained within housing/containing element 21. In FIG. 2, display/holding members 52, 53, 54, 55, 56, and 57 are depicted partially removed from housing/containing element 21, establishing a vertically staggered configuration with each element being fully shown, overlying an adjacent element. In FIG. 3, display/holding members 52-57 are shown in their fully displayed and extended configuration, with each display/holding member positioned directly adjacent each other forming a continuous, elongated, substantially straight line.

Figures 8, 8A, 8B:
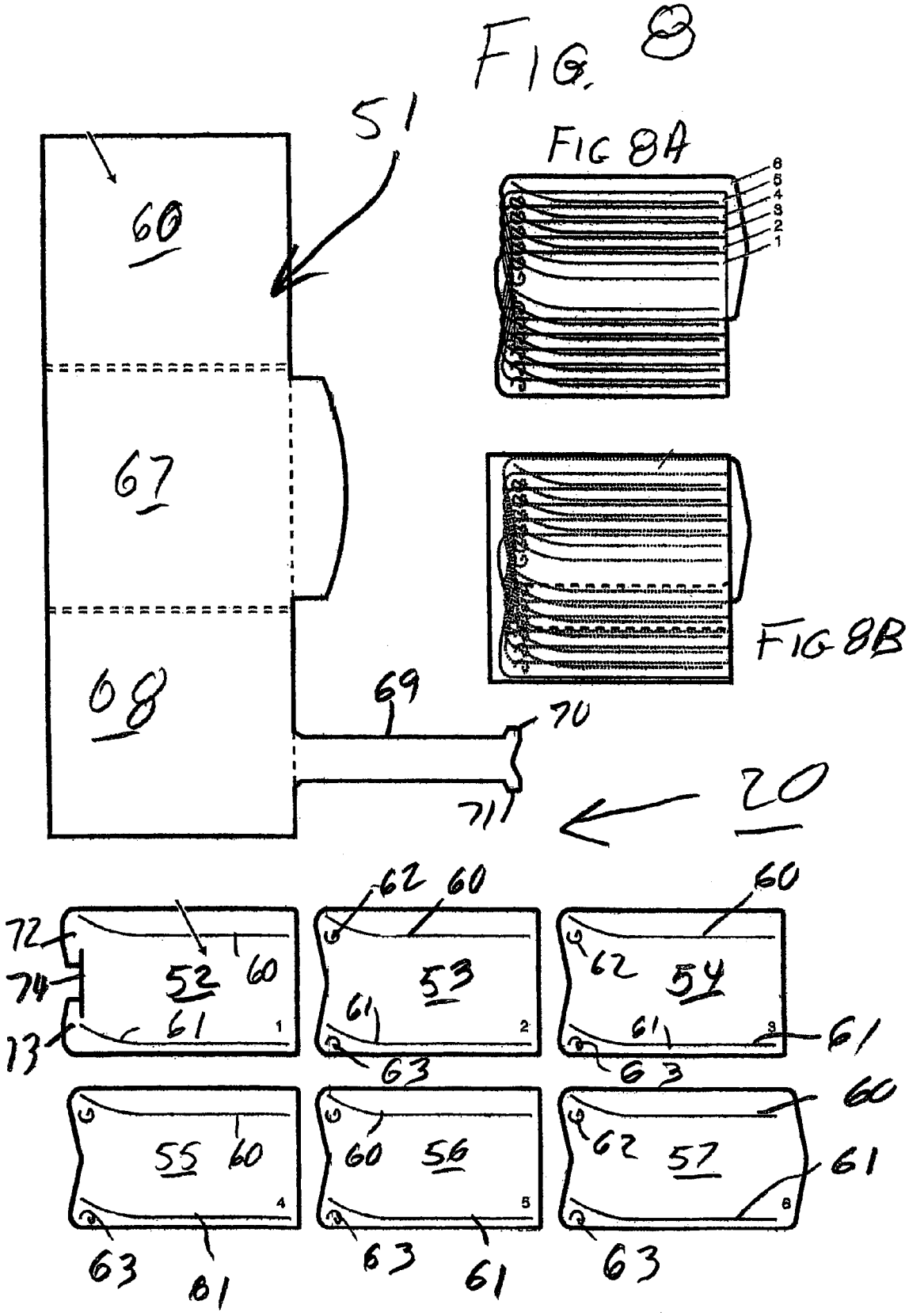
FIG. 8 is a top plan view of the multi-panel display and holding system of FIG. 5, with the panels depicted completely disassembled.

In order to achieve a visual display wherein display/holding members 52-57 each comprise substantially identical overall dimensions and configurations, display/holding members 52-57 must be constructed to be retained in housing/containing element 51 in an offset or staggered configuration. As best seen in FIGS. 8A and 8B, each display/holding member 52-57 is offset or vertically spaced away from each adjacent display/holding member. Although this configuration requires additional space to be formed in housing/containing element 51, this configuration enables display/holding members 52-57 to comprise substantially identical dimensions.

Furthermore, in order to enable display/holding members 52-57 to be positioned in a vertically offset manner while also being capable of being withdrawn from housing/containing element 21 in an arcuate path which enables display/holding members 52-57 to result in a final display wherein each display/holding member is positioned in an elongated, continuous, side to side, substantially straight-line configuration, display/holding members 52, 53, 54, 55, 56, and 57 comprise a pair of elongated, longitudinally extending, cooperating slots 60 and 61 which are formed adjacent the opposed side edges of each display/holding member. However, in this embodiment, elongated slots 60 and 61 each incorporate an arcuately curved portion in combination with a substantially straight, elongated portion.

Furthermore, display/holding members 53-57 each incorporate a pair of track engaging fingers or hook members 62 and 63, each of which are positioned directly adjacent the arcuately curved portion of slots 60 and 61. In addition, the track engaging fingers/hook members 62 and 63 are constructed for being engaged in elongated slots 60 and 61 of an adjacent display/holding member for enabling fingers/hook members 62 and 63 to slide along the arcuately curved portion and the substantially straight portion of slots 60 and 61, enabling the associated display/holding member to move in the precisely desired path.

As fully described above, track engaging fingers/hook members 62 and 63 of a first display/holding member are engaged in slots 60 and 61 of an adjacent display/holding member in order to assure that each display/holding member is withdrawn from housing/containing element 51 in its entirety, before the adjacent display/holding member is withdrawn. In addition, by constructing slots 60 and 61 in the manner detailed above, each display/holding a member is withdrawn and simultaneously positioned horizontally adjacent the next display/holding member.

In this way, each display/holding member is withdrawn in its entirety in a continuous, staggered, element by element construction, until all of the display/holding members are completely withdrawn and displayed in a continuous, elongated, side to side, substantially straight-line configuration. Once in this position, the indicia, advertising information, messages, designs, logos, colors, photographs, pictures, alphanumeric designations, etc. which are mounted, printed, and/or displayed on display/holding members 52-57 are seen in their entirety by the consumer or user.

In this embodiment, housing/containing element 51 is constructed in a manner similar to the construction detailed above, with housing/containing element 51 incorporating a plurality of cooperating panels 66, 67, and 68 which are foldable relative to each other. In this configuration, panels 66 and 67 form outside panels, with the surfaces thereof being visible to the consumer or user, while panel 68 forms an interior panel, captured between panel 66 and 67. In addition, in the preferred construction, interior panel 68 also incorporates elongated slide arm 69 integrally mounted to one edge of panel 68 and terminating at its opposed end with upstanding ridges 70 and 71.

In this embodiment, as with the embodiment detailed above, display/holding member 52 is constructed with locking fingers 72 and 73 formed on one end thereof in cooperating relationship with slot 74. This construction is configured for enabling elongated slide arm 69 to be telescopically inserted through slot 74, with locking fingers 72 and 73 peripherally surrounding and engaging arm 69.

When fully assembled, locking fingers 72 and 73 peripherally surround and embrace the edges of elongated slide arm 69, enabling display/holding member 52 to slide along the length of arm 69 through slot 74. However, the complete removal of display/holding member 52 from arm 79 is prevented, due to the engagement of upstanding ridges 70 and 71 with locking fingers 72 and 73. As a result, display/holding member 52 is capable of sliding along the length of arm 69, for being fully displayed when desired, while also being retained within housing/containing element 51 in a manner which prevents its complete removal.

Figure 9:
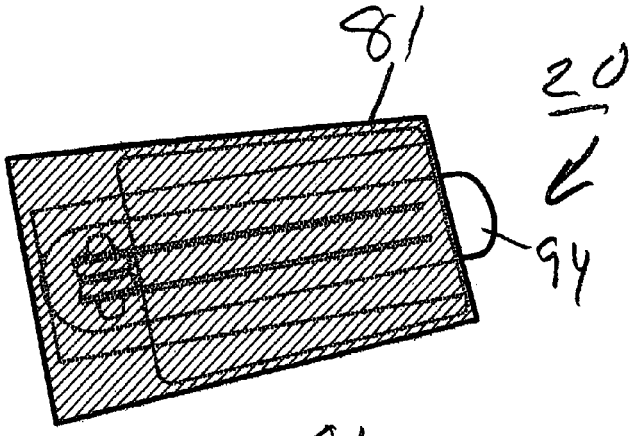
FIG. 9 is a perspective view of a still further embodiment the multi-panel display and holding system of the present invention shown with each of the panels in their closed, compact position retained in the housing.

In FIGS. 9-12, a further preferred embodiment of the present invention is depicted. In this embodiment, multi-panel display and holding system 20 of the present invention is shown comprising housing or containing element 81 in combination with display/holding members 82, 83, 84, 85, 86, and 87. In FIG. 9, multi-panel display and holding system 20 of the present invention is shown in its stored, fully compacted configuration, wherein each of the display/holding members 82-87 are mounted in overlying, cooperating relationship with each other, fully retained within housing/containing element 81. In FIG. 2, display/holding members 82-87 are all depicted partially removed from housing/containing element 81, while FIG. 3 depicts the display/holding members in their fully extended and displayed configuration.

As depicted, display/holding that members 82-87 are constructed in a manner which enables the display/holding members to be withdrawn from housing/containing element 81 in a continuous, elongated, substantially straight line, and remain in that configuration when fully displayed. As with the other embodiments detailed above, each display/holding member 82-87 is revealed in its entirety before the next display/holding member is revealed. In order to achieve the sequential visual display and configuration, display/holding members 82-87 are constructed for being in overlying, aligned, cooperating relationship with each other and retained in housing/containing element 81 with display/holding members 82-87 being in juxtaposed, overlying, facing relationship.

In the preferred construction of this embodiment of the present invention, display/holding members 82-87 each comprise a unique track system which allows display/holding members 82-87 to comprise substantially identical overall sizes and shapes. In addition, as fully detailed below, the track assembly employed in this embodiment of the present invention is formed as an extension of the display/holding zone of each display/holding member. As a result, the entire surface area forming the display/holding zone is available for receiving the desired indicia, photos, advertising information, messages, designs, logos, colors, pictures, alphanumeric designations, etc. which are mounted, printed, and/or formed for display thereon.

Figure 10:
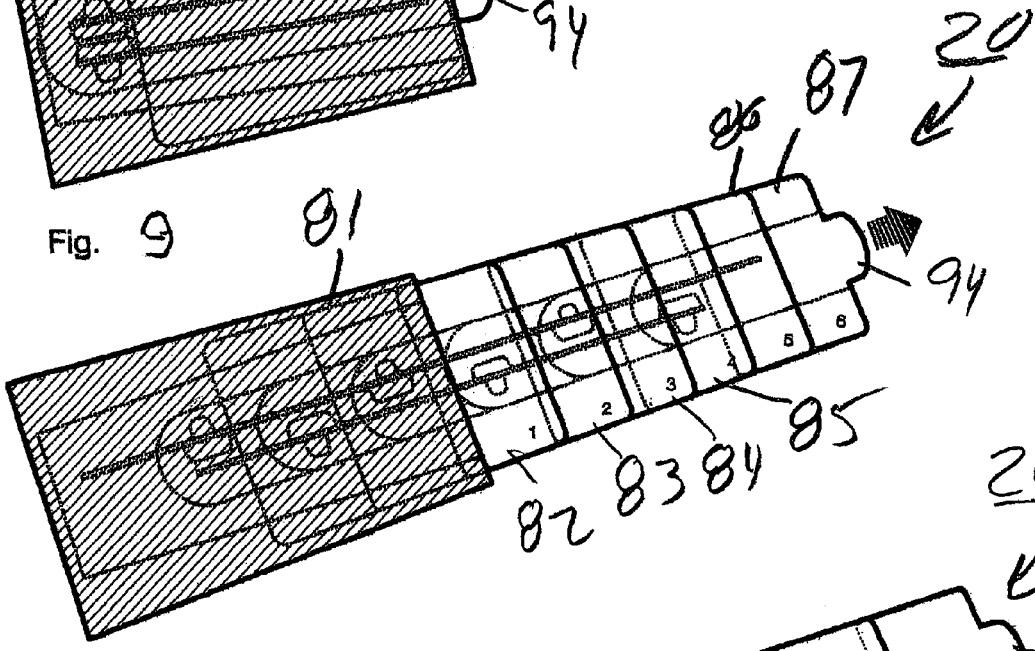
FIG. 10 is a perspective view of the multi-panel display and holding system of FIG. 9, shown with the panels partially removed from the housing.
Figure 11:
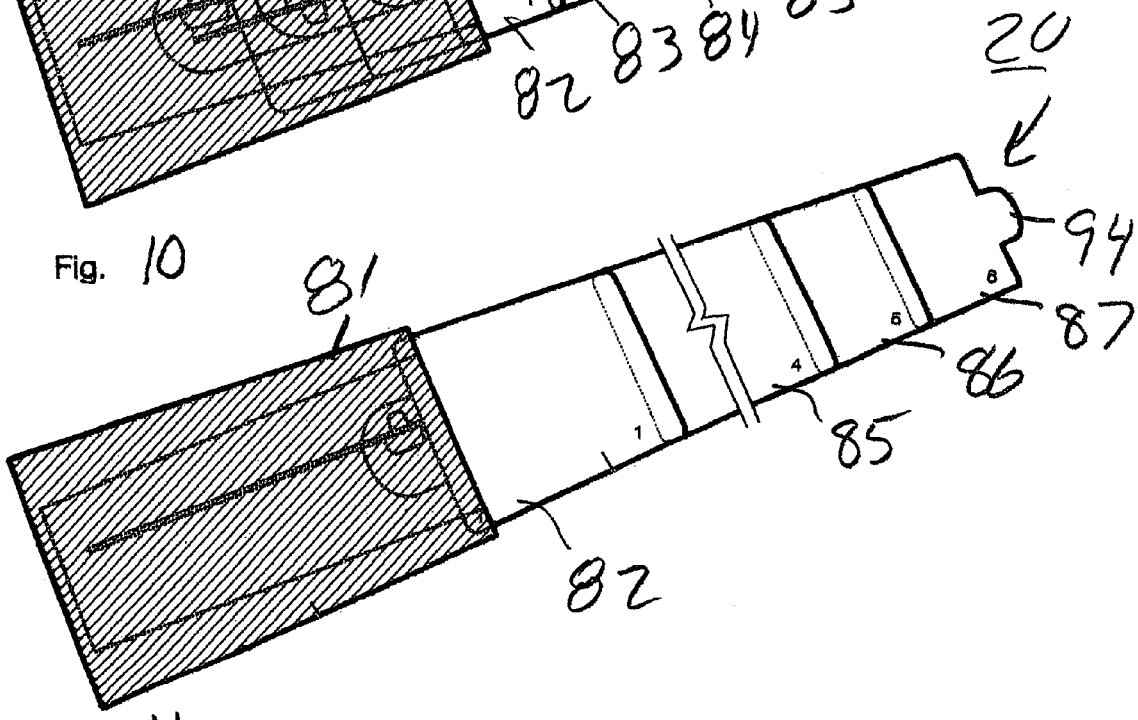
FIG. 11 is a perspective view of the multi-panel display and holding system of FIG. 9, shown with the panels completely extended from the housing.
Figure 12:
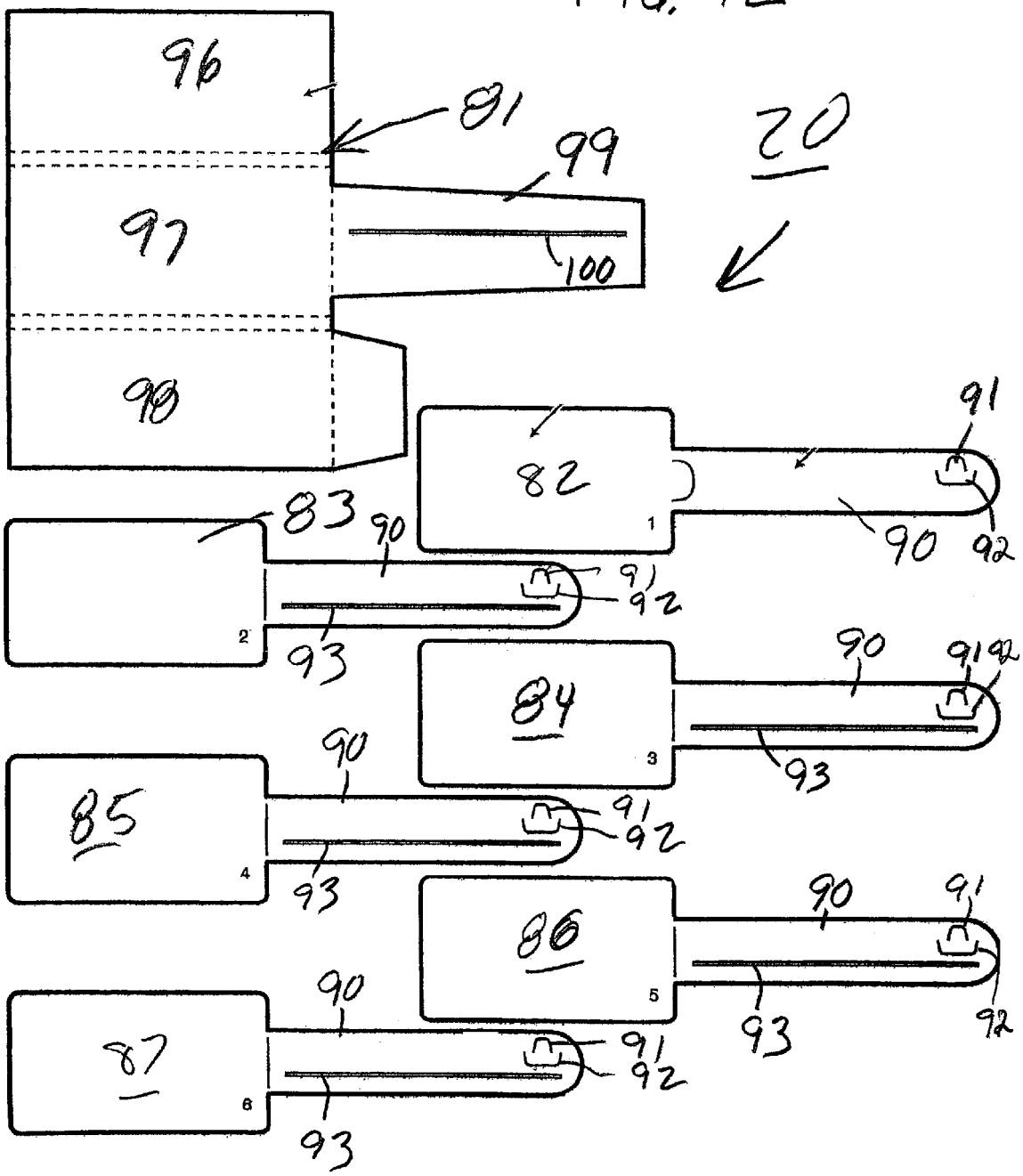
FIG. 12 is a top plan view of the multi-panel display and holding system of FIG. 9, with the panels depicted completely disassembled.

In order to achieve the desired continuous, longitudinally extending, side-by-side, cooperating, sequential display depicted in FIGS. 10 and 11 and detailed above, with each display/holding member 82-87 comprising display areas which are substantially identical in size and shape, each display/holding member 82-87 incorporates an elongated, longitudinally extending slide arm 90 which is integrally attached to one edge thereof. In addition, each slide arm 90 incorporates a pair of locking tabs 91 and 92 formed adjacent to each other and positioned near the terminating end of slide arm 90. Furthermore, slide arm 90 of display/holding members 83, 84, 85, 86, and 87 also incorporates a track-forming, longitudinally extending, substantially straight slot 93.

In constructing this embodiment of multi-panel display/holding system 20, slide arm 90 of each display/holding member is folded into overlying relationship with one surface of the display/holding member to which slide arm 90 is affixed. In addition, locking tabs 91 and 92 of slide arm 90 of one display/holding member are inserted through slot 93 of slide arm 90 of the adjacent display/holding member. Once each of the display/holding members 82-87 have been interconnected with each other in this manner, with tabs 91 and 92 of one slide arm 90 being inserted through slot 93 of an adjacent slide arm 90 of an adjacent display/holding member, the construction for display/holding system 20 is attained.

In addition, in order to achieve the complete overlying, aligned relationship of each of the display areas of each display/holding member 82-87, slot 93 is alternately positioned relative to the adjacent display/holding members, in order to allow tabs 91 and 92 of the adjacent slide arm to be easily inserted and lockingly engaged in slot 93. In this way, the desired longitudinal movement of each of the display/holding members is realized.

By employing the construction, as detailed above, each display/holding member 82-87 is withdrawn from housing/containing element 81 in a sequential manner, with each display/holding member being revealed in its entirety before the adjacent display/holding member is exposed. In order to enable the pulling force to be easily applied, display/holding member 87 incorporates a holding tab 94, as depicted in FIGS. 9, 10 and 11. By pulling holding tab 94, the required force is provided and each of the display/holding members retained in housing/containing element 81 are sequentially withdrawn for being fully exposed in their entirety.

As is evident from the foregoing detailed disclosure, when the required force is applied to holding tab 94, display/holding member 87 is withdrawn from housing/containing element 81. This desired longitudinal movement of display/holding member 87 relative to housing/containing element 81 and the remaining display/holding members retained therein, is achieved due to the engagement of locking tabs 91 and 92 in track forming slot 93 of slide arm 90 of display/holding member 87.

Due to this construction, display/holding member 87 is able to move longitudinally as locking arm 90 with slot 93 are able to move relative to display/holding member 86 along locking tabs 91 and 92. Once the entire length of track forming slot 93 has been traveled, display/holding member 86 is drawn out of housing/containing element 81 and longitudinally moves relative to display/holding member 85, due to the substantially equivalent construction detailed above.

By continuing to apply a force to tab 94, each of the display/holding members 82-87 are sequentially removed from housing/containing element 81 until the desired, continuous, elongated, side to side display of each display/holding member is attained. Once in this position, the particular indicia, advertising displays, messages, designs, logos, colors, photographs, pictures, alphanumeric designations, etc. which are mounted, printed, and/or formed on display/holding members 82-87 are readily visible in their entirety in order to provide the desired visual effect to the observer.

In the preferred construction of this embodiment of the present invention, housing/containing element 81 incorporates a plurality of cooperating panels 96, 97, and 98 which are foldable relative to each other, with panels 96 and 97 forming outside panels, the surfaces of which are visible. In this embodiment, panel 98 comprises an interior panel which is captured between panels 96 and 97. In addition, in this embodiment, panel 97 also incorporates an elongated slide arm 99 securely mounted to one edge thereof and incorporating an elongated, track-forming, longitudinally extending slot 100 formed therein.

In this embodiment, slot 100 forms the track along which display/holding member 82 is able to travel due to the engagement of locking tabs 91 and 92 therein. As a result, by constructing multi-panel display and holding system 20 in this manner, the desired visual display is realized, with each display/holding member 82-87 comprising a display surface which is substantially identical in size and shape, while also enabling display/holding members 82-87 to be mounted within housing/containing element 81 in a substantially stacked, overlying, aligned relationship.

Figure 13:
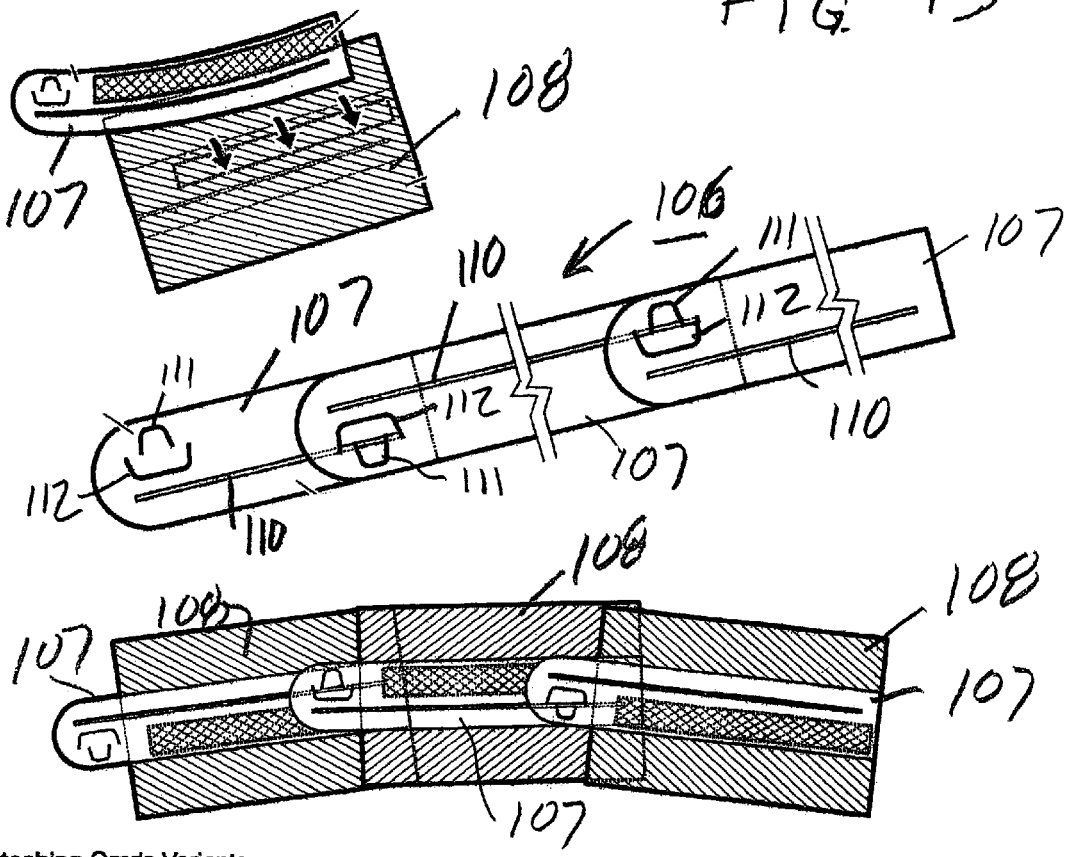
Figure 13:
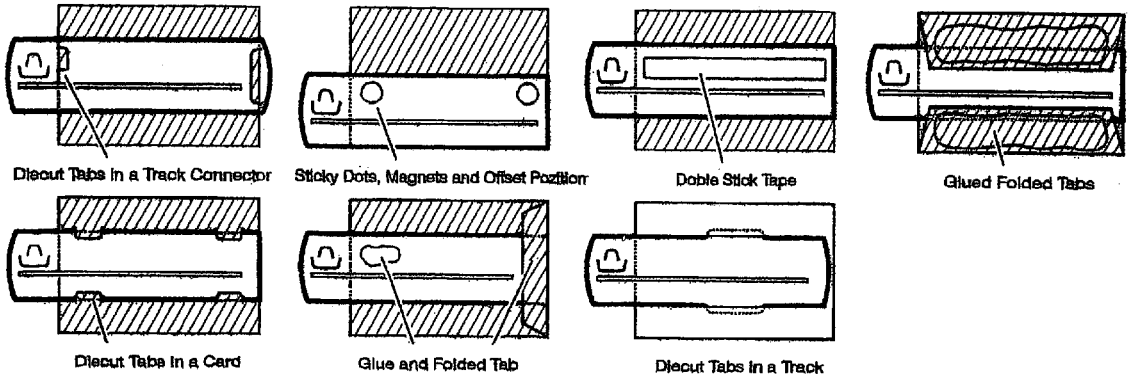
Figure 14:
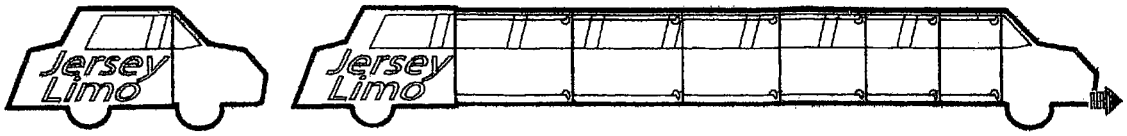
Figure 15:
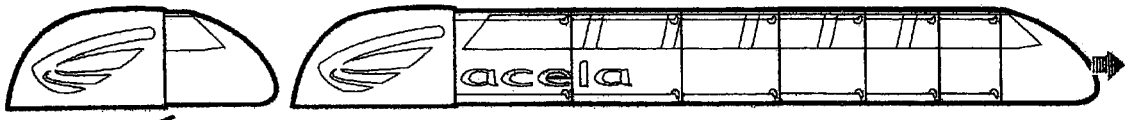
Figure 16:
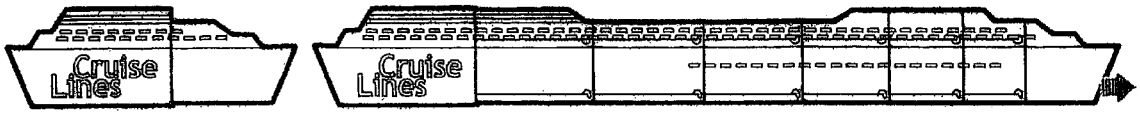
Figure 17:
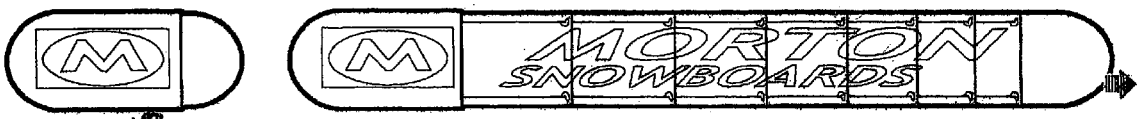
Figure 18:
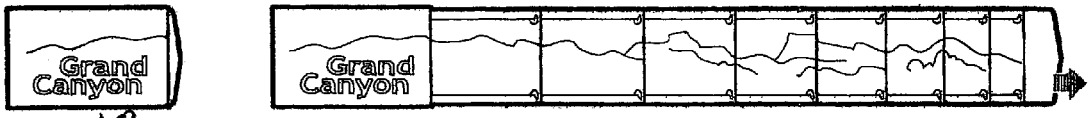
Figure 19:
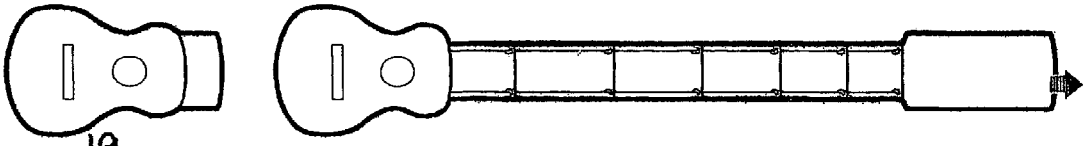
Figure 20:
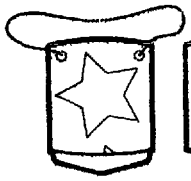
Figure 21:
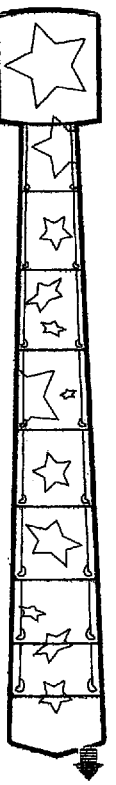
Figure 22:
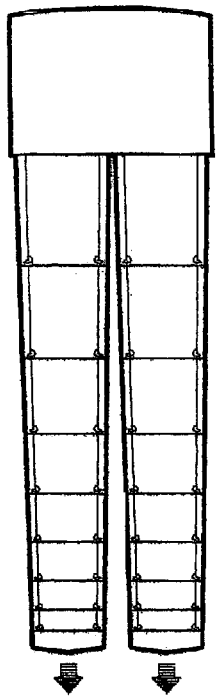
Figure 23:
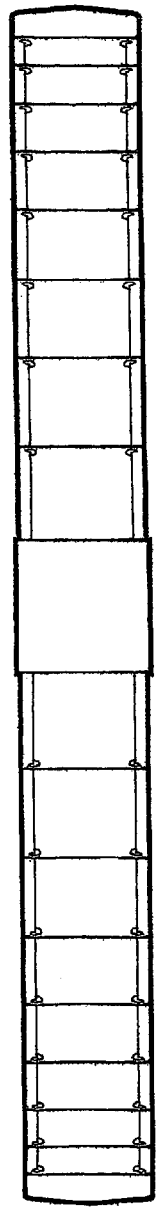
Figure 23:
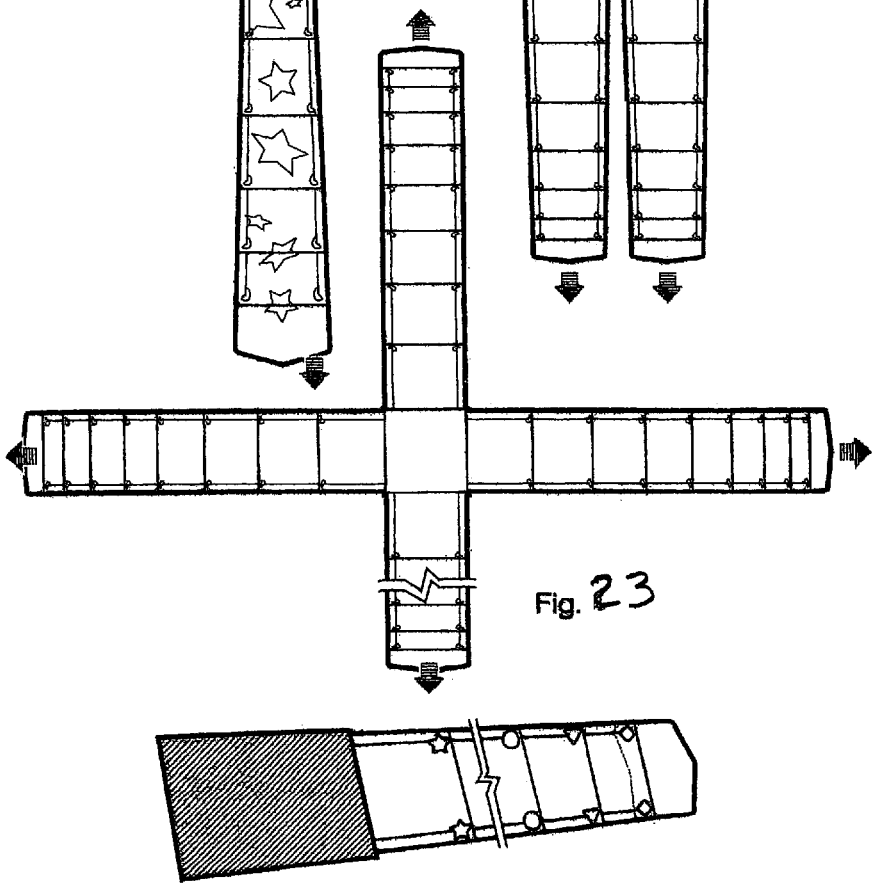

In FIG. 13, a further alternate embodiment of the present invention is depicted, wherein a separate, independent track system is employed, which is affixed to any desired display/holding member. By employing this embodiment of the present invention, the display/holding member may incorporate any desired size, shape, configuration, etc., while also being stackable in overlying, aligned relationship with each other. In this way, a wide variety of alternate, eye-catching, visually distinctive constructions can be attained.

As shown in FIG. 13, track system 106 incorporates a plurality of track forming members 107 which are mounted in cooperating relationship with each other. Although three, cooperating, track forming members 107 are depicted, any desired quantity of track forming members may be employed.

Furthermore, as shown, each track forming number 107 is affixed to any desired display/holding number 108 in order to form the desired multi-panel display and holding system 20 of the present invention. In this regard, track forming members 107 are securely affixed to display/holding members 108 using a wide variety of alternate methods, depending upon the particular application desired. Included in these methods are the use of adhesives, locking tabs, magnets, double-sided adhesive tape, glues, and dice-cut tabs, folded engagements, and the like.

In the preferred construction of this embodiment of the present invention, each track forming member 107 incorporates a separate and independent elongated strip of material in which an elongated, longitudinally extending, slot 110 is formed in combination with slot engaging locking tabs 111 and 112. As with the embodiment detailed above, tabs 111 and 112 are inserted into elongated slot 110 and lockingly engaged therein, for controlling the relative movement of each track forming member 107 relative to an adjacent track forming member 107.

Once each of the track forming members 107 have been securely affixed to a particular desired display/holding member 108, the desired construction is realized. As discussed above, in the preferred construction, the position of elongated slot 110 is alternated on each adjacent member in order to enable display/holding members 108 to be stackable in overlying, aligned vertical relationship.

By referring to FIGS. 14-30, a wide variety of alternate products, constructions and configurations can be seen which depicts numerous alternate uses for which the present invention can be employed. Clearly, these alternate products, constructions, and configurations are provided for exemplary purposes only, as an indication of the wide scope and diversity of the present invention and the broad applicability the present invention has to numerous commercially desirable products uses, and advertising/promotional displays. It is to be understood, however, that these depicted products, uses, and advertising/promotional displays are provided for exemplary purposes only to indicate the breath of the present invention and are not intended as a limitation of the present invention or its broad commercial applicability.

It will thus be seen that the objects set forth above, among those made apparent from the preceding description, are efficiently attained and, since certain changes may be made in the above articles without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A display and/or holding system:

A. comprising a plurality of display/holding members cooperatively associated with each other and constructed for movement between a first, compact position and a second, fully extended and displaying position wherein said members are sequentially aligned with each other to form a continuous elongated array;

B. each of said display/holding members comprising a substantially flat or planar construction having a front surface and a rear surface and being interconnected to at least one adjacent display/holding member for enabling a first one of said members to be longitudinally extendable relative to a second one of said members, with the first member being movable from the first compact position in overlying aligned relationship with the second member into the second extended position wherein the first member is longitudinally extending away from said second member;

C. comprising control means cooperatively associated with the display/holding members for enabling the first member to move longitudinally from its first position into its second position relative to the second member while remaining securely engaged with the second member in its fully extended position, and D. a housing member a. mounted to the first display/holding member for enabling the first display/holding member to be longitudinally movable relative to the housing member while preventing the first display/holding member from being disconnected from the housing member, b. constructed for peripherally surrounding and maintaining the plurality of display/holding members in overlying aligned relationship with each other when said members are in their first position; and c. comprising a movement control member formed by an elongated slide arm mounted in said housing, said slide arm incorporating longitudinally extending side edges terminating with an abutment stop and being constructed for cooperating engagement with slide arm engaging members formed on the first display/holding member for enabling said first display/holding member to be freely longitudinally movable relative to the housing member from a first fully engaged position within said housing member to a second extended position outwardly from the housing member, while being connected to the housing member when fully extended outwardly therefrom due to contact between the slide arm engaging members and the abutment stop;

whereby the display/holding system is achieved which enables each display/holding member to move longitudinally relative to an adjacent display/holding member to provide a continuous, elongated array of said display/holding members when in their fully extended position.

2. The display/holding system defined in claim 1, wherein said plurality of display/holding members comprises at least three separate and independent display/holding members with the second display/holding member being interconnected with and longitudinally movable relative to the first display/holding member, while a third display/holding member is interconnected with and longitudinally movable relative to the second display/holding member, whereby said display/holding members provide an elongated, continuous, longitudinally extending array when said members are in their second display position.

3. The display/holding system defined in claim 2, wherein said control means is further defined as comprising at least one elongated track formed on at least one of said display/holding members and at least one track engaging member formed on at least one other of said display/holding members and constructed for locking interengagement with said track and longitudinal movement along said track when said display/holding member is moved relative thereto.

4. The display/holding system defined in claim 3, wherein said at least one elongated track is further defined as comprising a pair of track forming slots formed in at least one two of said three display/holding members and said at least track engaging member is further defined as comprising a pair of cooperating track engaging members formed on at least two of said three display/holding members, with the slots being aligned in juxtaposed, spaced, parallel relationship with each other for causing the track engaging members of the adjacent display/holding member to be controllably moved along said length of slots whenever the adjacent display/holding member is longitudinally moved.

5. The display/holding system defined in claim 4, wherein said pair of slots is further defined as being formed in one configuration selected from the group consisting of straight lines, arcuately curved lines, and combinations thereof.

6. The display/holding system defined in claim 1, wherein said plurality of display/holding members are further defined as being constructed for being in overlying, aligned relationship with each other when said display/holding members are in their first compact position.

7. The display/holding system defined in claim 6, wherein each of said plurality of display/holding members are further defined as comprising dissimilar overall lengths for enabling said display/holding members to be positioned in the first overlying compact configuration.

8. The display/holding system defined in claim 1, wherein each of said plurality of display/holding members are further defined as comprising substantially identical overall lengths and the plurality of display/holding members are offset from each other in vertically aligned relationship when said display/holding members are in their first compact position.

9. The display/holding system defined in claim 1, wherein each of said display/holding members are further defined as comprising a substantially rectangular shape constructed for enabling any desired indicia to be printed thereon or any desired graphic material to be mounted thereto.

10. The display/holding system defined in claim 9, wherein the indicia printed on each of said display/holding members are interrelated for providing a display which graphically represents an item, structure, or product visually depicted in the first compact position when said display/holding members are in their first position and visually depicting the item, structure, or product in an elongated, substantially continuous, longitudinally extending configuration when the display/holding system is in the second, fully extended position.

11. The display/holding system defined in claim 10, wherein said item, structure, or product comprises one selected from the group consisting of buildings, automobiles, trains, cruise ships, snowboards, musical instruments, monuments, landmarks, sports equipment, and alphanumeric displays.

12. The display/holding system defined in claim 1, wherein said abutment stops are defined as ridges or flanges formed at a terminating end of the slide arm and extending in opposite directions outwardly from the side edge thereof.

13. A display and/or holding system:

A. comprising a plurality of display/holding members cooperatively associated with each other and constructed for movement between a first, compact position and a second, fully extended and displaying position wherein said members are sequentially aligned with each other to form a continuous elongated array;

B. each of said display/holding members comprising a front surface and a rear surface and being interconnected to at least one adjacent display/holding member for enabling a first one of said members to be longitudinally extendable relative to a second one of said members, with the first member being movable from the first position in overlying aligned relationship with the second member into the second position wherein the first member is longitudinally extending away from said second member;

C. comprising control means a. cooperatively associated with the display/holding members for enabling the first member to move longitudinally from its first position into its second position relative to the second member while remaining securely engaged with the second member in its fully extended position; and b. comprising a plurality of separate and independent strips of material each comprising an elongated slot formed therein and a slot engaging follower formed at one end of said strip, whereby the plurality of strips are mounted to the plurality of display/holding members for enabling the slot engaging follower of one strip to engage the slot of the adjacent strip thereby enabling the display/holding members associated therewith to be longitudinally movable relative to each other, whereby the display/holding system is achieved which enables each display/holding member to move longitudinally relative to an adjacent display/holding member to provide a continuous, elongated array of said display/holding members when in their fully extended position.

14. The display/holding system defined in claim 13, wherein each of said strips of material are further defined as being securely affixed to one of said plurality of display/holding members for enabling one of said plurality of strips to be mounted to one of said plurality of display/holding members.

15. The display/holding system defined in claim 14, wherein each of said strips of material are further defined as comprising adhesive means for enabling each of said strips of material to be mounted to each of said display/holding members.

16. A display and/or holding system:

A. comprising a plurality of display/holding members cooperatively associated with each other and constructed for movement between a first, compact position and a second, fully extended and displaying position wherein said members are sequentially aligned with each other to form a continuous elongated array;

B. each of said display/holding members comprising a front surface and a rear surface and being interconnected to at least one adjacent display/holding member for enabling a first one of said members to be longitudinally extendable relative to a second one of said members, with the first member being movable from a first position in overlying aligned relationship with the second member into a second position wherein the first member is longitudinally extending away from said second member;

C. comprising control means a. cooperatively associated with the display/holding members for enabling the first member to move longitudinally from its first position into its second position relative to the second member while remaining securely engaged with the second member in its fully extended position; and b. comprising an elongated, longitudinally extending control means forming extension mounted to one edge of the display/holding members and incorporating an elongated slot formed therein and extending substantially the entire length thereof and a slot engaging follower mounted near the terminating end thereof, whereby each control means forming extension is folded into overlying alignment and secure engagement with the display/holding member associated therewith, and the slot engaging follower formed therein is lockingly engaged with the elongated slot of the adjacent display/holding member for providing the desired longitudinally extending construction, whereby the display/holding system is achieved which enables each display/holding member to move longitudinally relative to an adjacent display/holding member to provide the continuous, elongated array of said display/holding members when in their fully extended position.

* * * * *